US006601514B1

(12) United States Patent
Bretfeld et al.

(10) Patent No.: US 6,601,514 B1
(45) Date of Patent: Aug. 5, 2003

(54) EXTERNALLY CONTROLLED IGNITION UNIT WITH INTEGRATED ELECTRONIC SYSTEM FOR TRIGGERING A RESTRAINT SYSTEM

(75) Inventors: Anton Bretfeld, Farth (DE); Gerhard Kordel, Narnberg (DE); Horst Laucht, Bruckmuhl (DE); Erwin Caflisch, Tamins (CH); Richard Baur, Pfaffenhofen (DE); Michael Bischoff, Adelschlag (DE); Gunter Fendt, Schrobenhausen (DE); Stefan Schwehr, Nuremberg (DE)

(73) Assignees: Dynamit Nobel GmbH Explosivstoff-und Systemtechnik, Troisdorf (DE); Temic Telefunken Microelectric GmbH, Narnberg (DE); TRW Airbag Systems GmbH & Co., KG, Aschau/Inn (DE); Unax AG, Tamis (CH)

( * ) Notice: Subject to any disclaimer, the term of this patent is extended or adjusted under 35 U.S.C. 154(b) by 0 days.

(21) Appl. No.: 09/762,534

(22) PCT Filed: Jul. 29, 1999

(86) PCT No.: PCT/EP99/05420

§ 371 (c)(1),
(2), (4) Date: Jul. 5, 2001

(87) PCT Pub. No.: WO00/09964

PCT Pub. Date: Feb. 24, 2000

(30) Foreign Application Priority Data

Aug. 11, 1998 (DE) ..... 198 36 278

(51) Int. Cl.[7] ..... F42B 3/10
(52) U.S. Cl. ..... 102/202.12
(58) Field of Search ..... 102/202.12, 202.5, 102/202.9

(56) References Cited

U.S. PATENT DOCUMENTS 2,972,951 A * 2/1961 Stresau ..... 102/202.9
3,780,656 A * 12/1973 Murray ..... 102/357
3,909,567 A * 9/1975 Brown ..... 313/487
5,140,906 A * 8/1992 Little, II ..... 102/202.14
5,544,585 A * 8/1996 Duguet ..... 102/202.5
5,639,986 A * 6/1997 Evans ..... 102/202.1
5,672,841 A * 9/1997 Monk et al. ..... 102/202.1
5,763,814 A * 6/1998 Avory et al. ..... 102/202
6,009,809 A * 1/2000 Whang ..... 102/202.14
6,220,163 B1 * 4/2001 Duguet et al. ..... 102/202.2
6,289,813 B1 * 9/2001 Duguet et al. ..... 102/202.14
6,408,758 B1 * 6/2002 Duguet ..... 102/202.14

FOREIGN PATENT DOCUMENTS

| | | |
|---|---|---|
| DE | 3401513 | 7/1985 |
| DE | 3532850 | 3/1987 |
| DE | 4038460 | 6/1992 |
| EP | 0269475 A1 * | 10/1987 |

* cited by examiner

*Primary Examiner*—Charles T. Jordan
*Assistant Examiner*—Jordan M Lofdahl
(74) *Attorney, Agent, or Firm*—Antonelli, Terry, Stout & Kraus, LLP

(57) ABSTRACT

The invention relates to an ignition unit (1) suitable for triggering an active system, such as an airbag or safety belt. The ignition unit comprises an ignition charge (7) located in a housing (2), which can be fired by means of an ignition bridge (6) positioned on a support element (5), as well as at least one contact pin (13*a*, 13*b*, 13*c*) which protrudes from the housing (2) and via an electronic ignition system (9) is electrically connected to the ignition bridge (6). The electronic ignition system (9) is surrounded by an envelope (10) made of a shock-absorbing material. The ignition bridge (6) is not covered by the envelope (10) so that during ignition the pressure exerted on the electronic ignition system (9) is cushioned. This prevents damage to the sensitive electronic components of the electronic ignition system (9) situated on the support element (5).

11 Claims, 2 Drawing Sheets

EXTERNALLY CONTROLLED IGNITION UNIT WITH INTEGRATED ELECTRONIC SYSTEM FOR TRIGGERING A RESTRAINT SYSTEM

BACKGROUND OF THE INVENTION

The invention relates to an electronic ignition unit for triggering an active system, in particular restraint system, such as, for example, a seat-belt tensioner or airbag.

Such ignition units contain an ignition bridge in the form of, for example, a wire resistor or a film component and an ignition charge generally composed of a solid and which is in communication with the ignition bridge. In the event of the ignition unit being triggered, a current flows through the ignition bridge. The heat produced ignites the ignition charge, which, while expanding considerably, is converted into the gaseous state to produce a pressure that may be up to a few 100 bar. The gas can then enter a restraint system or the gas generator of an airbag or seat-belt tensioner through a predetermined breaking point in the housing of the ignition unit.

Such an ignition unit is described in DE 37 17 149, from which the preamble of claim 1 proceeds. The ignition unit has a solid housing through which contact pins for connection to a control line are brought out on the contact side. Formed on the opposite side of the housing is a cavity which contains the ignition charge and also the electronic ignition system connected to the contact pins. The electronic system is situated on a support that is securely disposed on the base of the cavity, while the ignition charge is disposed above the electrical system so that the gases produced after the ignition can escape upwards from the housing. During this process, the gases exert a force on the support element that may destroy the latter and, consequently, also the electronic ignition system.

Frequently, ignition units are operated on a bus system to which a plurality of ignition units is connected and on which the bus stations communicate bidirectionally. If the electronic ignition system of an individual ignition unit is destroyed during ignition, the communication on the bus may be interrupted so that the other stations can also no longer be activated.

SUMMARY OF THE INVENTION

The object of the invention is to provide an ignition unit in which the serviceability of the electronic ignition system is still given even after the triggering of the ignition element.

This object is achieved, according to the invention, by the support element and the electronic ignition system being at least partially covered with shock-absorbing material that reduces impact acting on the electronic ignition system during ignition.

The ignition unit has a housing that contains an ignition charge that is partly surrounded by a housing insert. The ignition charge is ignited by an ignition bridge that is disposed on a support element. Also situated on the support element is an electronic ignition system that is electrically connected to the ignition bridge and activates the latter. Electrically connected to the electronic ignition system is at least one contact pin that is led out of the housing in order to connect the ignition unit to an ignition line (bus). Alternatively, the ignition unit may also have sockets or other connecting elements.

The invention is based on the principle of covering the support element and the electronic ignition system disposed thereon at least partly with shock-absorbing material. The impact energy produced during the ignition of the ignition charge is dissipated by the shock-absorbing material before the pressure surge reaches the sensitive electronic ignition system. This ensures that the electronic ignition system functions even after the triggering of the ignition charge.

The shock-absorbing material may be disposed above the support element, i.e. between the support element and the ignition charge. In this case, the enveloping material cushions the impact energy generated by the ignition charge. The support element may be mounted in such a way that it yields as a result of bending to the pressure produced during the ignition.

The shock-absorbing material may also be disposed underneath the support element, i.e. on the side remote from the ignition charge. The pressure produced during the ignition then forces the support element downwards and, in this process, the shock-absorbing material underneath dissipates the energy. The two variants can be combined with one another.

Preferably, the support element and the electronic ignition system are surrounded by an envelope of shock-absorbing material, which envelope essentially only leaves the ignition bridge exposed. In this case, the cushioning at the top of the support element is achieved both by the housing insert and by the envelope. The envelope likewise undertakes the damping at the bottom of the support element. The hardnesses of the materials of the envelope and of the housing insert depend in this connection on the pressure to be expected and also on the sensitivity of the support element or the electronic ignition system disposed thereon. The ignition bridge is not covered by the envelope, but is in direct contact with the ignition charge. The pressure acting on the support element in the region of the ignition bridge has no adverse effects on the electrical conductors or electronic components since the latter are disposed completely inside the envelope. The pressure produced during the ignition is reduced by the deformation of the envelope or of the housing insert, with the result that the diminished pressure acting on the electronic ignition system does not damage the latter. The electronic components or conductors situated on the support element are therefore operational even after the ignition, with the result that clearly defined electrical states prevail between the contact pins. In addition, an electronic ignition system can issue items of information, for example about the state of the ignition unit, to a control computer even after triggering. This may be, for example, a status signal indicating that the ignition unit has been ignited. The bus line always remains undamaged, with the result that further ignition elements can be ignited.

In an advantageous embodiment of the invention, the cushioning properties of the material of the housing insert differ from those of the envelope. This two-stage structure makes possible improved, graduated pressure relief, it being possible, in addition, to cushion special pressure variations through the configuration of the interface between envelope and housing insert.

Preferably, the hardness of the material of the envelope is greater than that of the housing insert. This structure makes possible a good cushioning of the surge produced during the ignition process. In this case, the housing insert undertakes, to a certain extent, the function of a preliminary cushioning in which some of the pressure forces are already dissipated, while the remaining forces are reduced by the stiffer envelope. It is also possible for the housing insert to be composed of a harder material.

The support element may have a predetermined breaking point, and in this case no components or electrical conductors of the electronic ignition system are present in the region of the predetermined breaking point. In this way, excess energy can be reduced without the electronic ignition system being exposed to a dangerously increased pressure.

The electrical connection between the contact pins and the electronic ignition system disposed on the support element can be designed so as to be mechanically displaceable. This has the advantage that the support element can move during the ignition process independently of the contact pins, which permits small movements of the support element and, in addition, prevents the contact pins from being moved, which may result in damage to the ignition line plug connected to the contact pins. The connection between support element or the ignition bridge disposed thereon and the contact pins can be designed so that the support element has contact elements that are connected to the ignition bridge and that are applied to the contact pins, the support element being capable of displacement along the contact pins. During such movement, the contact elements remain continually in contact with the contact pins. The electronic ignition system of the support element may also be connected to the contact pins by flexible electrical conductors (bonding wire).

BRIEF DESCRIPTION OF THE DRAWINGS

An exemplifying embodiment of the invention is described in greater detail below with reference to the drawings.

In the drawings.

DETAILED DESCRIPTION OF THE PREFERRED EMBODIMENTS

Figure 1:
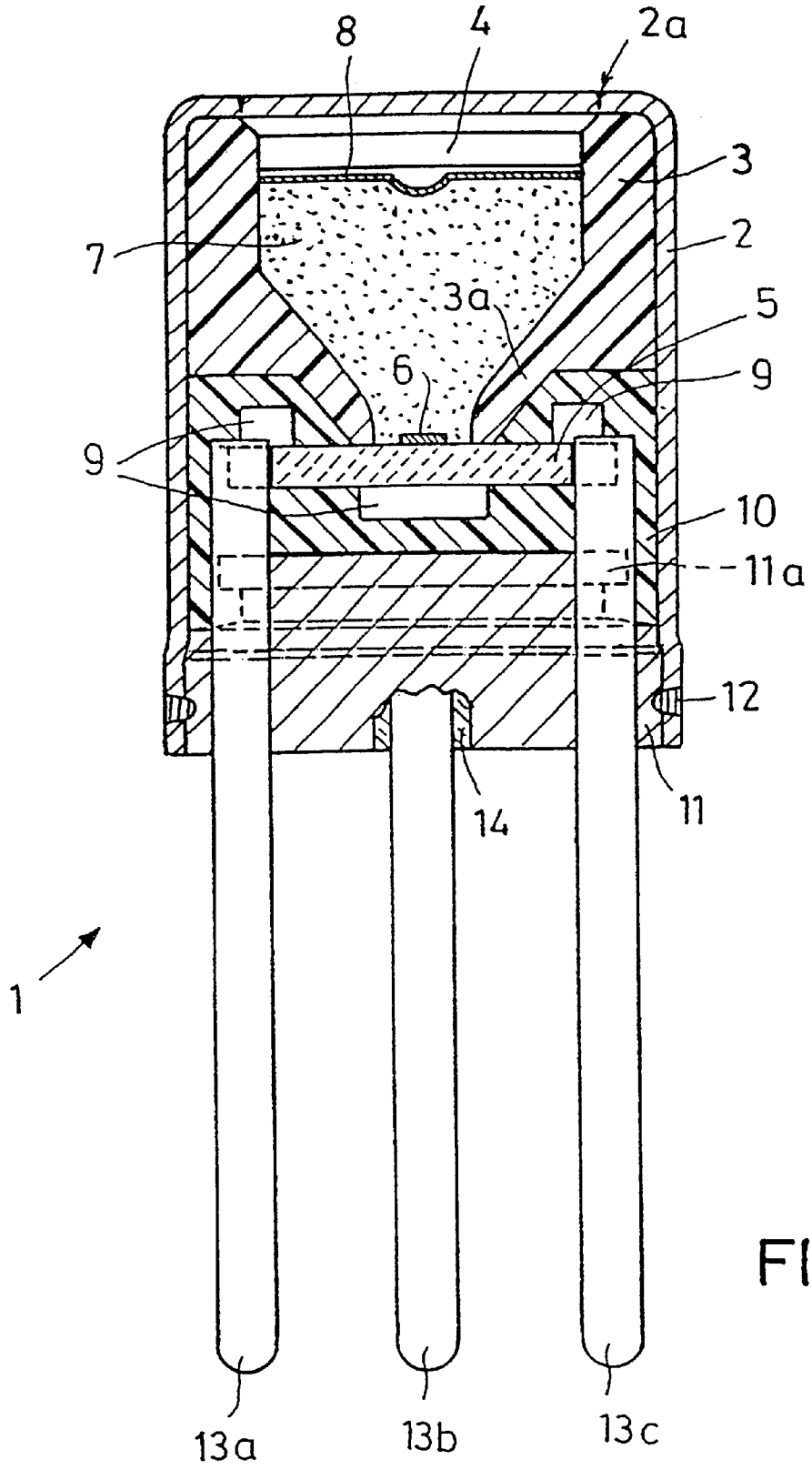
FIG. 1 shows a sectional view of an ignition unit.

The ignition unit 1 shown in FIG. 1 has a pot-shaped housing 2 whose lower end face is open. The housing 2 is composed of sheet metal in order to prevent an outgassing of the ignition charge and in order to shield the electronic system contained in the ignition unit 1 from radiation. Fitted into the upper region of the housing 2 is a housing insert 3, which has a central, essentially funnel-shaped charge bore 4. The larger opening of the charge bore 4 abuts the upper end face of the housing 2, the housing 2 having a star-shaped predetermined breaking point 2*a* in the region of the larger opening of the charge bore 4.

Situated underneath the housing insert 3 is a support element 5 on which an ignition bridge 6 in the form of a film resistor is situated. The support element 5 is composed of a solid material, such as, for example, the ceramic material $Al_2O_3$. The support element 5 may also be a printed circuit board. The ignition bridge 6 is situated in the smaller opening of the charge bore 4. The charge bore 4 of the housing insert 3, which charge bore is tightly sealed at the bottom by the support element 5, is filled with an ignition charge 7. In this case, the ignition charge 7 is composed of one component; it is, however, possible also to use two-stage or multi-stage ignition charges. The ignition charge 7, which is compacted in the charge bore 4, is terminated at the top with a cover 8 so that a tight packing layer is guaranteed. Shown on the top and bottom of the support element 5 by way of example are some components of an electronic ignition system 9.

The support element 5 and the electronic ignition system 9 are surrounded by an envelope 10 of shock-absorbing material, although the ignition bridge 6 and also the region of the support element 5 surrounding it are not covered by the envelope 10. At that point, the envelope 10 has a central funnel-shaped opening whose larger opening area faces upwards. The housing insert 3 and the envelope engage one another in such a way that a circularly circumferential rim 3*a* that forms the boundary of the charge bore 4 rests on the wall of the opening of the envelope 10. The ignition charge 7 situated in the charge bore 4 therefore does not come into contact with the envelope 10.

The housing insert 3 and the envelope 10 are composed of a plastics material, such as, for example, a thermoplastic, resin, rubber or fibre material, the hardness of the material of the envelope 10 being greater than that of the housing insert 3. The housing insert 3 is composed of a relatively soft material. The envelope 10, on the other hand, is composed of a relatively hard material that still does not, however, make it possible for the support element 5 suspended in the envelope 10 to vibrate or undergo small movement. The support element 5 can therefore give way to the pressure peak produced during the ignition and, consequently, reduce further the force acting on the support element 5, which is already reduced by the deformation of the housing insert 3 and the envelope 10. The selection of the material, namely, on the one hand, a relatively soft material for the housing insert 3 and, on the other hand, a relatively hard material for the envelope 10, is determined by the pressure that is built up inside the charge bore 4 and, consequently, on the support element 5 and also by the sensitivity of the support element 5 or of the electronic ignition system 9 disposed thereon. The higher the expected pressure is, the harder are the two materials chosen. The material of the housing insert 3 is of a hardness such that it is not too severely distorted under the influence of the gas pressure that is built up in the charge bore 4, but still permits a preliminary cushioning. The main cushioning is then undertaken by the envelope 10 composed of a harder material.

Disposed underneath the envelope 10 is a metallic lead-through base 11 in the form of a so-called glass/metal lead-through, which tightly seals the housing 2. The housing 2 and the lead-through base 11 are joined together by means of a circumferential welding seam 12. Three metal contact pins 13*a*, 13*b*, 13*c* are brought out through the lead-through base 11. Formed around each of the contact pins 13*a*, 13*b*, 13*c* in the lead-through base 11 is a glass seal 14 that insulates the respective contact pin 13 and the lead-through base 11 electrically from one another. On the top, the lead-through base 11 has a shoulder 11*a* having an undercut in which an annular bead of the envelope 10 engages, with the result that the envelope 10 is firmly held in the housing.

Figure 2:
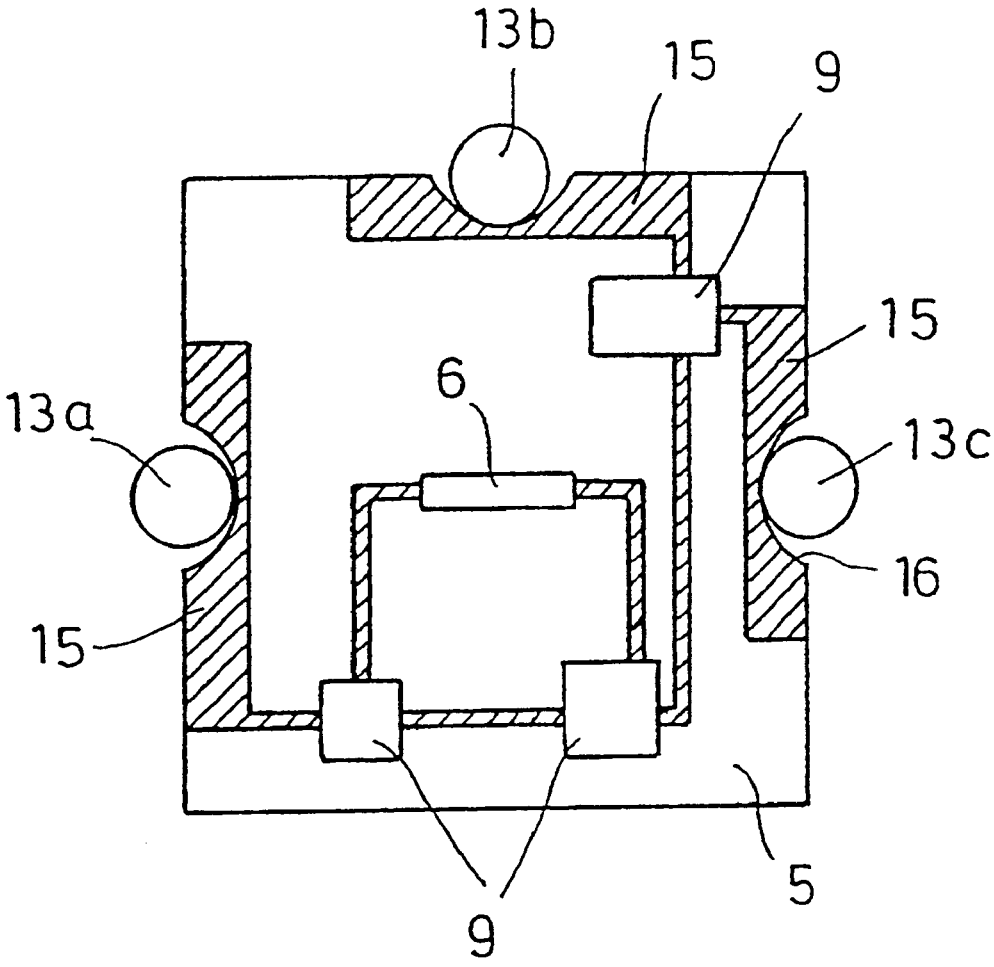
FIG. 2 shows a plan view of the support element with abutting contact pins.

At their tops, the contact pins 13*a*, 13*b*, 13*c* mutually engage with the contact elements 15 (FIG. 2). The contact elements 15 are, for example, printed on the nonconducting support element 5. Formed at the outer edge of the contact elements 15, i.e. those edges that coincide with the boundary edge of the support element 5, is in each case an approximately semicircular charge bore 16. One contact pin 13 engages in each case in each of the charge bores 16. In order to achieve a better electrical junction between contact pin 13 and contact element 15, the wall surface of the charge bore 16, i.e. that surface that extends in the direction of the longitudinal axis of the contact pins 13 and against which the contact pins 13 abut, is also provided with an electrically conducting layer that is a component of the contact element 15. To compensate for manufacturing tolerances or to make possible movements of the support element 5 between the quite rigid contact pins 13, the radius of the charge bore 16 is greater than the radius of the contact pin 13.

The contact elements 15 are connected to conductor tracks or conductors that are connected to components of the electronic ignition system 9. The electronic ignition system 9 is connected in turn via conductor tracks to the ignition bridge 6.

In the event of triggering, the ignition unit 1 receives an appropriate signal via the bus system. The signal is passed to the contact elements 15 via the contact pins 13*a*, 13*b*, 13*c* and conducted from that point to the electronic ignition system 9. If the address is correct and if the signal is an ignition signal, the electronic ignition system 9 applies an ignition current to the ignition bridge 6, for example with the aid of a previously charged capacitor. Such ignition bridge heats up and the heat produced in the process ignites the ignition charge 7, which is converted to the gaseous state while expanding considerably and destroys the cover 8 in the process and also opens the housing 2 at the predetermined breaking point 2*a*. The gas can then be used, for example, for a seat-belt tensioning system or for igniting a gas generator for an airbag. Up to the point in time at which the predetermined breaking point 2*a* ruptures, the gas pressure also acts on the support element 5. The housing insert 3 undertakes the function of preliminary cushioning, while the main cushioning is performed by the envelope 10. In addition, the support element 5 can give way downwards so that the pressure acting on the support element 5 and the electronic ignition system 9 is reduced further. At the same time, that part of the envelope 10 that is situated between the support element 5 and the lead-through base 11 cushions the impact. The electronic components of the electronic ignition system 9 that are disposed on the top of the support element 5 are also enclosed by the envelope 10 so that those pressure components that proceed downwards or in a lateral direction from the funnel region of the charge bore 4 are likewise cushioned to such an extent that they do not damage the electronic system. The material and the geometry, i.e. in particular the height of the envelope 10 determining the maximum movement of the support element 5 are designed in such a way that the support element 5 can move at least until the point in time at which the predetermined breaking point 2*a* ruptures.

What is claimed is:

1. Ignition unit for triggering an active system, in particular a restraint system, comprising an ignition charge that is disposed in a housing and is partly surrounded by a housing insert, a support element that is disposed in the housing and on which are disposed an ignition bridge for igniting the ignition charge and an electronic ignition system connected to the ignition bridge, and at least one contact pin that is electrically connected to the electronic ignition system and that is led out of the housing, characterized in that the support element and the electronic ignition system are at least partly covered with shock-absorbing material that reduces impact acting on the electronic ignition system during ignition.

2. Ignition unit according to claim 1, characterized in that the support element and the electronic ignition system are surrounded by an envelope made of a shock-absorbing material, which envelope essentially leaves only the ignition bridge exposed.

3. Ignition unit for triggering an active system, in particular a restraint system, comprising an ignition charge that is disposed in a housing and is partly surrounded by a housing insert, a support element that is disposed in the housing and on which are disposed an ignition bridge for igniting the ignition charge and an electronic ignition system connected to the ignition bridge, and at least one contact pin that is electrically connected to the electronic ignition system and that is led out of the housing, characterized in that the support element and the electronic ignition system are at least partly embedded in an envelope made of a shock-absorbing material, which envelope essentially leaves only the ignition bridge exposed, the cushioning properties of the housing insert being different from those of the envelope so that the envelope reduces impact acting on the electronic ignition system during ignition so as to maintain serviceability of the electronic ignition system even after triggering.

4. Ignition unit according to claim 2, characterized in that the envelope is composed of a harder material than the housing insert.

5. Ignition unit according to claim 1, characterized in that the support element has a predetermined breaking point, wherein no components of the electronic ignition system are disposed in the region of the predetermined breaking point.

6. Ignition unit according to claim 1, characterized in that the support element has contact elements and can be displaced with the contact elements along the contact pins.

7. Ignition unit according to claim 1, characterized in that the support element or the electronic ignition system is connected to the contact pins via flexible electrical conductors.

8. Ignition unit according to claim 1, characterized in that the electronic ignition system contains a communication section for operating the ignition unit on a bus system.

9. Ignition unit according to claim 1, characterized in that the shock-absorbing material is plastic.

10. Ignition unit according to claim 9, characterized in that the plastic is selected from the group consisting of thermoplastic resin, rubber and fibre material.

11. Ignition unit according to claim 9, characterized in that the support element and the electronic ignition system are surrounded by an envelope made of a shock-absorbing material, which envelope leaves the ignition bridge exposed.

* * * * *